US007955144B2

(12) United States Patent
Thoerner

(10) Patent No.: US 7,955,144 B2
(45) Date of Patent: Jun. 7, 2011

(54) BANANA PLUG WITH A BODY WITH A CONTACT SEGMENT EXTENDED INTO AN ADJOINING CAGE

(76) Inventor: Wolfgang B. Thoerner, Essen (DE)

( * ) Notice: Subject to any disclaimer, the term of this patent is extended or adjusted under 35 U.S.C. 154(b) by 0 days.

(21) Appl. No.: 12/735,664

(22) PCT Filed: Feb. 6, 2009

(86) PCT No.: PCT/EP2009/000843

§ 371 (c)(1),
(2), (4) Date: Nov. 1, 2010

(87) PCT Pub. No.: WO2009/098075

PCT Pub. Date: Aug. 13, 2009

(65) Prior Publication Data

US 2011/0045711 A1 Feb. 24, 2011

(30) Foreign Application Priority Data

Feb. 6, 2008 (DE) ..... 10 2008 007 866

(51) Int. Cl.
*H01R 13/05* (2006.01)

(52) U.S. Cl. ..... 439/825

(58) Field of Classification Search ..... 439/825, 439/827, 884, 265, 668, 669

See application file for complete search history.

(56) References Cited

U.S. PATENT DOCUMENTS

| | | | | |
|---|---|---|---|---|
| 2,851,669 | A * | 9/1958 | Koch | 439/265 |
| 4,384,758 | A * | 5/1983 | Lee et al. | 439/265 |
| 4,596,440 | A * | 6/1986 | Quam | 439/827 |
| 4,824,405 | A * | 4/1989 | Derain | 439/807 |
| 5,011,438 | A * | 4/1991 | Awbrey | 439/825 |
| 5,197,908 | A * | 3/1993 | Nelson | 439/825 |
| 5,951,337 | A * | 9/1999 | Brake | 439/825 |
| 7,758,593 | B2 * | 7/2010 | Nobis et al. | 606/113 |
| 2004/0248476 | A1 * | 12/2004 | Zhang | 439/825 |

FOREIGN PATENT DOCUMENTS

| | | |
|---|---|---|
| DE | 11 86 926 | 2/1965 |
| DE | 27 11 859 | 9/1978 |
| DE | 295 04 240 | 8/1995 |
| DE | 297 03 602 | 5/1997 |

* cited by examiner

*Primary Examiner* — Chandrika Prasad
(74) *Attorney, Agent, or Firm* — Collard & Roe, P.C.

(57) ABSTRACT

The invention relates to an electrical plug connector, in particular a banana plug, having a base body (2) and having a contact pin (3) which is arranged on the front face of the base body (2), with the base body (2) having a connecting cage (4) for holding a connecting cable and for making an electrically conductive connection to the contact pin (3). The invention is based on the object of providing a better plug connector. The plug connector is intended to have good characteristics for transmission of audio signals. A further aim is that it should be possible to produce the plug connector at low cost. In order to achieve this object, the invention proposes that the contact pin (3) comprise two or more contact segments (5) and be in the form of a metallic stamped and bent part, with at least one of the contact segments (5) being at least partially embedded in the base body (2), which is composed of plastic, and extending into the interior of the connecting cage (4).

17 Claims, 4 Drawing Sheets

BANANA PLUG WITH A BODY WITH A CONTACT SEGMENT EXTENDED INTO AN ADJOINING CAGE

CROSS REFERENCE TO RELATED APPLICATIONS

Figure 1:
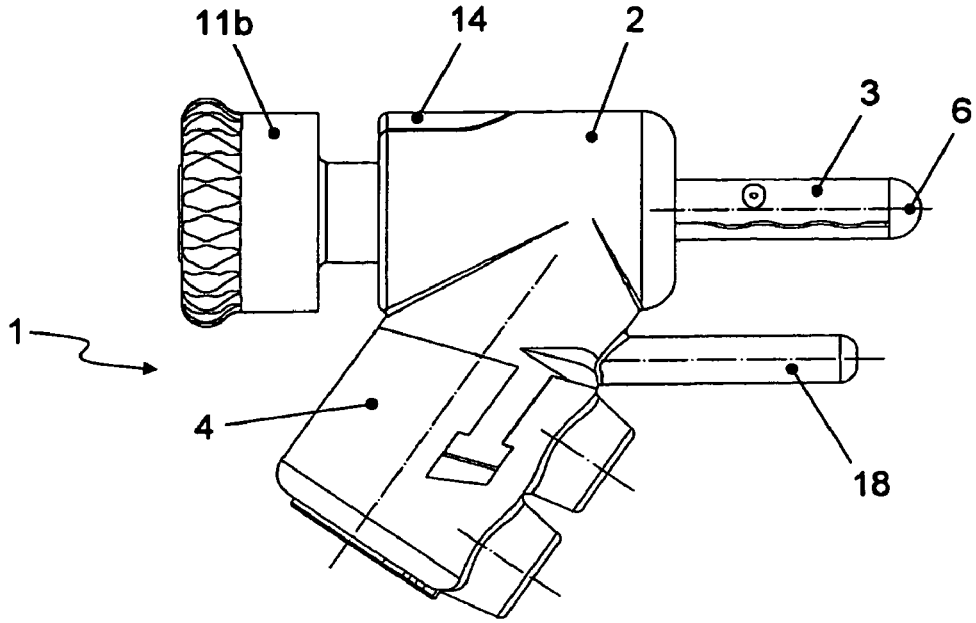

This application is the National Stage of PCT/EP2009/000843 filed on Feb. 6, 2009 which claims priority under 35 U.S.C. §119 of German Application No. 10 2008 007 866.2 filed on Feb. 6, 2008, the disclosure of which is incorporated by reference. The international application under PCT article 21(2) was not published in English.

The invention relates to an electrical plug connector, particularly a banana plug, having a base body and a contact pin disposed on the front side of the base body, whereby the base body has a connecting cage for accommodating a connecting cable and for producing an electrically conductive connection with the contact pin.

A so-called banana plug is a common electrical plug connector. Its principle was developed in electrical laboratories at the beginning of the $20^{th}$ century, as a replacement for complicated screw/squeeze connections in test wiring setups that had to be changed frequently. Because of its contact principle and its standard dimensions, it is particularly suitable for use in releasable loudspeaker connections with non-extreme cable cross-sections in high-quality hi-fi systems.

For use in the hi-fi sector, so-called angled banana plugs are known from the state of the art, for example from DE 295 04 240 U1. These are characterized by their angled construction, which is particularly advantageous with regard to handling. In the case of angled banana plugs, the base body of the plug has a section that is angled as compared with its longitudinal axis, which section forms the connecting cage for accommodating the connecting cable. The connecting cage comprises a cavity having a contact element disposed within it, for producing an electrical connection between the connecting cable and the contact pin. The connecting cable can be introduced into the connecting cage through an introduction opening. The connecting cable can be fixed in place in the interior of the connecting cage, in most cases by way of suitable clamping screws, whereby the connecting cable is pressed against the contact element. Angled banana plugs of the aforementioned type are furthermore configured so that they can be braced. This means that the contact pin can be widened radially. The contact pin can therefore be braced in the related jack, whereby the contact surfaces of the contact pin are pressed against the contact surfaces of a corresponding plug jack under high contact pressure. As a result, a particularly low transition resistance and thus an excellent electrical connection are obtained.

In the case of the angled banana plug previously known from DE 295 04 240 U1, as mentioned above, the base body, having the angled connecting cage and the contact pin, consists of a one-piece, homogeneous material piece. This results in various disadvantages.

In the case of the known angled banana plug, the base body, including the angled connecting cage and the contact pin, is formed from a correspondingly shaped one-piece hot-pressed part made of brass, bronze, red brass, or the like. The cavity of the connecting cage as well as threads and bores are produced by means of cutting machining. The use of better conductive materials, such as pure copper or pure silver, for example, is not absolutely necessary for reasons of electrical resistance, namely because of the large cross-sections of the one-piece base body in the known plug design. For reasons of processing technology, the use of better conductive materials is not possible, since pure copper or pure silver, for example are not suitable for cutting machining. For cost reasons, the use of materials such as copper or silver for the base body of an angled banana plug of a conventional design would actually be nonsensical. Nevertheless, the use of materials having higher conductivity would open up improvement potentials for banana plugs used in the hi-fi sector. This is because the coupling and conduction capacitances that are formed by the voluminous base body of the conventional construction could be reduced with such materials, specifically by means of the possibility of the significant reduction in the metallic conductive masses. At the same time, a reduction in the active and passive EMI problem locations of the conventional plug design would be achieved in this way. Furthermore, a reduced conductive volume offers no or at least less room for the formation of eddy currents, whose interference with the signal currents leads to significant impairment of the signal reproduction.

Against this background, it is the task of the invention to make available an improved electrical plug connector. A banana plug is supposed to be created, which allows transmission of audio signals at high sound quality. At the same time, it is supposed to be possible to produce the plug in cost-advantageous manner.

This task is accomplished by the invention, proceeding from an electrical plug connector of the type indicated initially, in that the contact pin comprises two or more contact segments and is configured as a metallic stamped and bent part, whereby at least one of the contact segments is at least partially embedded in the base body, which consists of plastic, and extends into the interior of the connecting cage.

According to the invention, the contact pin of the banana plug is configured to be segmented. The contact pin is produced from metallic flat material, which is given the shape required for functioning by means of bending technology deformation. A material having high conductivity, such as copper or silver, for example, can be used for the contact pin. So that the specific conductivity of the material of the contact pin is adapted to the conductivity of the connecting cables usually used in the hi-fi sector, the specific conductivity of the material should amount to at least $50\times10^6$ S/m, preferably at least $55\times10^6$ S/m, most preferably at least $60\times10^6$ S/m. Copper and silver can be used without problems, since no cutting machining of the material is required.

At least one of the contact segments of the contact pin is at least partially embedded into the base body, which consists of plastic. The base body therefore consists essentially of plastic in the case of the plug connector according to the invention. The plastic material forms the supporting structure of the plug connector. The at least one contact segment can be embedded in the material of the base body by means of injection-molding the body around it. The plug connector according to the invention therefore has a lower metal proportion as compared with conventional angled banana plugs. The disadvantages described above, which result from the configuration of the base body as a solid metal part, are therefore avoided by the invention. The plug connector according to the invention is optimized not only with regard to its electrical properties in signal transmission, but also with regard to the production costs.

The electrical plug connector according to the invention can be used like a conventional angled banana plug. The connection is made in usual manner, in that the corresponding connecting cable is electrically connected with the contact pin in the connecting cage. For this purpose, it is provided, according to the invention, that the at least one contact segment, which is embedded in the base body that consists of plastic, extends into the interior of the connecting cage. There, the electrical connection with the connecting cable is produced.

According to a practical further development of the plug according to the invention, the contact pin consists of at least two contact segments that are connected with one another at the front end of the contact pin, whereby one of the contact segments is extended in length as compared with the other contact segments, and has a connecting surface for the connecting cable on its end side. In this embodiment, the metallic stamped part of the contact pin—seen in the developed view—has a star shape. Proceeding from this shape, the shape required for functioning of the contact pin can be produced using only a few bending technology deformation steps. At the same time, the connection of the segments at the tip of the contact pin ensures good mechanical stability. The plug can be plugged into a corresponding jack multiple times, without any problems, without any damage to the contact pin having to be feared, for example due to bending of the contact segments. The end of one of the contact segments is configured as a connecting surface for the connecting cable. The corresponding contact segment is embedded in the plastic material of the base body, whereby the connecting surface is situated at the end of the contact segment, in the interior of the connecting cage, so that an electrical connection with the connecting cable can be produced there.

It is practical if the extended contact segment lies against the inside wall in the interior of the connecting cage, whereby the connecting cable can be pressed against the connecting surface by means of at least one clamping screw. In this embodiment, the contact segment supports itself on the inside wall of the connecting cage, in the region of the connecting surface for the connecting cable. Thus, the connecting surface of the contact pin can be used to produce a clamping connection with the connecting cable. The clamping forces that occur are absorbed by the base body, which consists of plastic, on which the contact segment in question supports itself.

In order to guarantee sufficient mechanical stability, the at least one clamping screw can be guided in a metallic thread plate that is embedded into the base body in the region of the connecting cage. In the production of a clamping connection with the connecting cable, significant forces might occur, under some circumstances. These forces could put too much stress on a thread formed in the plastic material of the base body. In order to minimize the risk of damage to the plug connector in cases in which the clamping screw is severely over-tightened, it is practical to use a metallic threaded plate in which the thread for the clamping screw is formed. Only a minimally increased metal proportion of the overall plug design results from the threaded plate. The properties of the plug in the transmission of audio signals are not measurably influenced by this.

In conventional manner, in the plug connector according to the invention, the connecting cage can have an introduction opening for the connecting cable, whereby the at least one clamping screw stands transverse to the introduction direction of the connecting cable. This results in practical handling of the plug connector according to the invention, which handling corresponds to that of conventional angled banana plugs.

According to a practical further development, the electrical plug connector according to the invention has a spreader pin that can be screwed into the base body, from its back, whereby the spreader pin extends into the contact pin with its front end, which narrows conically toward the front, so that the contact pin can be radially widened by screwing the spreader pin in. As a result of the radial widening, the outer contact surface of the contact pin can be pressed against the inner contact surface of a corresponding jack, in order to produce a particularly good electrical connection and to fix the plug connector in place in the jack. The spreader pin is disposed coaxial to the contact pin. For bracing, the spreader pin is screwed into the base body, whereby the conically narrowing end of the spreader pin moves forward, into the contact pin. In this connection, the contact segments of the contact pin are pushed outward.

It is practical if the spreader pin comprises a metallic spindle and a handle part made of plastic, whereby the spindle is embedded in the plastic material of the handle part and whereby the handle part has an outside thread that is guided in an inside thread of the base body. In this embodiment, only the spindle consists of metal, while the handle part consists of plastic. The metallic spindle ensures that the mechanical forces that occur when the plug is braced in a related jack are reliably transferred. Because of the production of the spindle from metal, less wear is furthermore guaranteed, even if the plug connector is frequently released and braced again. The production of the handle part of the spreader pin from plastic brings about the result that the metal proportion in total is kept low.

According to a practical further development of the braceable plug connector according to the invention, a slit spreader sleeve made of spring-elastic material is disposed in the interior of the contact pin, whereby the front end of the spreader pin, which narrows conically, moves into the spreader sleeve when the pin is screwed in, and widens the sleeve when this is done. The inside diameter of the spreader sleeve is less, in the unbraced state, than the outside diameter of the spindle of the spreader pin. When the spindle moves into the spreader sleeve, the latter is widened. The spreader sleeve ensures that the radial forces that occur during bracing are uniformly transferred to the contact segments of the contact pin over the entire surface of the spreader sleeve, so that the outer contact surface of the contact pin is uniformly pressed against the inner contact surface of a related jack. In the case of the plug connector according to the invention, the contact pin, as explained above, consists of a flat metallic material, for example of copper or silver. The flat contact segments have little elasticity. The elastic spreader sleeve ensures that permanent plastic deformations of the contact pin do not occur during bracing of the plug. Furthermore, the spreader sleeve prevents direct mechanical contact of the front end of the spreader pin with the inside surface of the contact pin. As a result, abrasion and wear of and also damage to the comparatively sensitive contact segments during bracing are prevented.

According to another practical embodiment, the electrical plug connector according to the invention has a latch that can be releasably connected with the base body, whereby the latch has a locking projection that engages into a circumferential groove of the spreader pin and thus prevents the spreader pin from being completely screwed out of the base body. The latch ensures that the spreader pin can only be screwed out of the base body as far as is necessary to release the bracing. The spreader pin, which is disposed in the interior of the contact pin, ensures stabilization of the contact pin. Screwing the spreader pin out completely could lead to destabilization of the contact pin, so that the risk of damage to the contact pin would be present when it is inserted into a jack. Furthermore, loss of the spreader pin is also effectively prevented by the latch.

An alternative possibility for producing a good electrical connection by means of pressing the outer contact surface of the contact pin against the inner contact surface of the corresponding jack by means of radial widening of the contact pin consists in disposing an elastically deformable spreader body that stands under radial bias in the interior of the contact pin, which body widens the contact pin radially and elastically. This variant is more cost-advantageous, since the spreader pin mentioned above is eliminated. The spreader body stabilizes the contact pin sufficiently, so that no damage occurs when it is inserted into the jack. At the same time, insertion of the plug into the jack does not cause any problems, since the spreader body ensures that the outside diameter of the contact pin automatically adapts precisely to the inside diameter of the jack, without overly large friction forces occurring.

Furthermore, an embodiment of the plug connector according to the invention is practical, in which an adaptation sleeve that can be inserted into the introduction opening of the connecting cage is provided, whereby the inside diameter of the adaptation sleeve essentially corresponds to the outside diameter of the connecting cable. The adaptation sleeve serves essentially for strain relief. Depending on the diameter of the connecting cable used, an adaptation sleeve having a corresponding diameter can be inserted into the introduction opening of the connecting cage. In order to fix the adaptation sleeve in place in the introduction opening of the connecting cage, it can be provided that the adaptation sleeve has a passage bore for one of the clamping screws of the connecting cage. In this embodiment, the connecting cable and the adaptation sleeve are fixed in place with the same clamping screw.

As was explained above, so-called angled banana plugs have proven themselves. It is practical if the electrical plug connector according to the invention is configured accordingly, in such a manner that the base body has a section angled transverse to its longitudinal axis, which section forms the connecting cage. The angle between the longitudinal axis of the base body and the longitudinal axis of the connecting cage advantageously lies between 30° and 90°. The base body of the electrical plug connector can be configured in multiple parts, specifically in such a manner that the section that forms the connecting cage can be removed. The removable section can be engaged into the base body by way of suitable catch crosspieces, for example. It can be practical to configure the connecting cage to be interchangeable, for example in order to adapt the plug connector to different types of connecting cables. It is also possible to use connecting cages of different colors, for example for the purpose of marking the polarity (for example red for the plus pole, black for the minus pole).

According to a further development of the electrical plug connector according to the invention, a security pin that runs parallel to the contact pin is formed onto the base body, which pin prevents the contact pin from being inserted into a power outlet. If one attempts to insert the banana plug according to the invention into an opening of a power outlet, then the front end of the security pin comes up against the housing of the power outlet and prevents insertion. When the banana plug is inserted into a corresponding installation jack on the housing of a loudspeaker or an amplifier of a hi-fi system, the security pin is not in the way, since the installation jacks of hi-fi systems usually project so far out of the housing that the security pin does not make contact with the housing.

Figure 2:
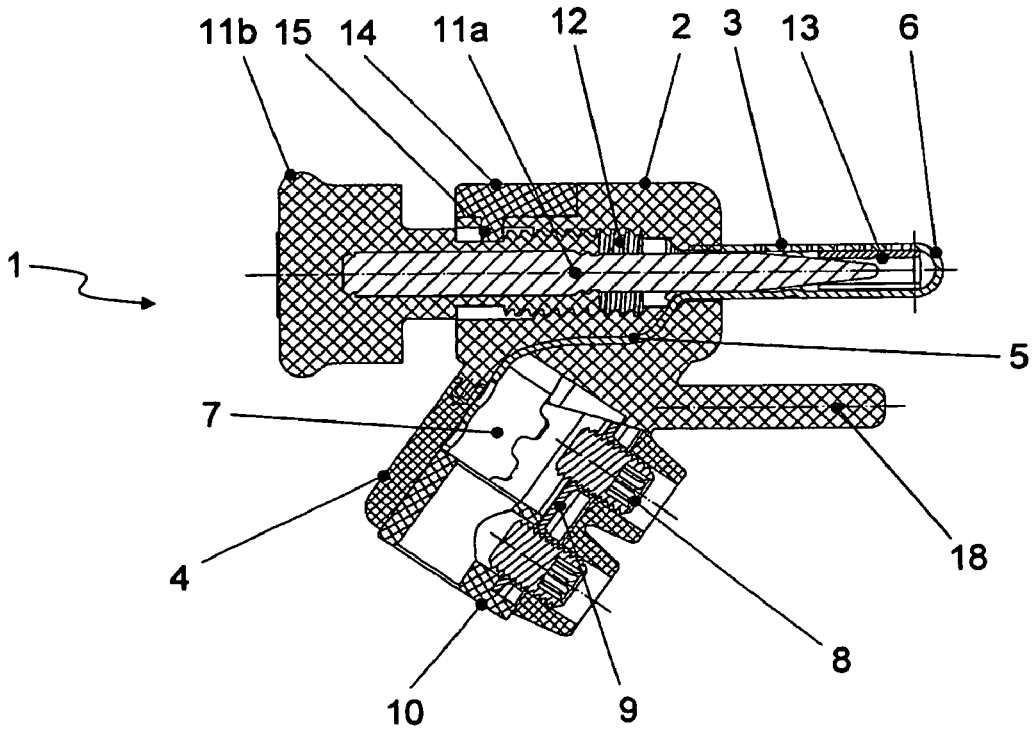
Figure 3:
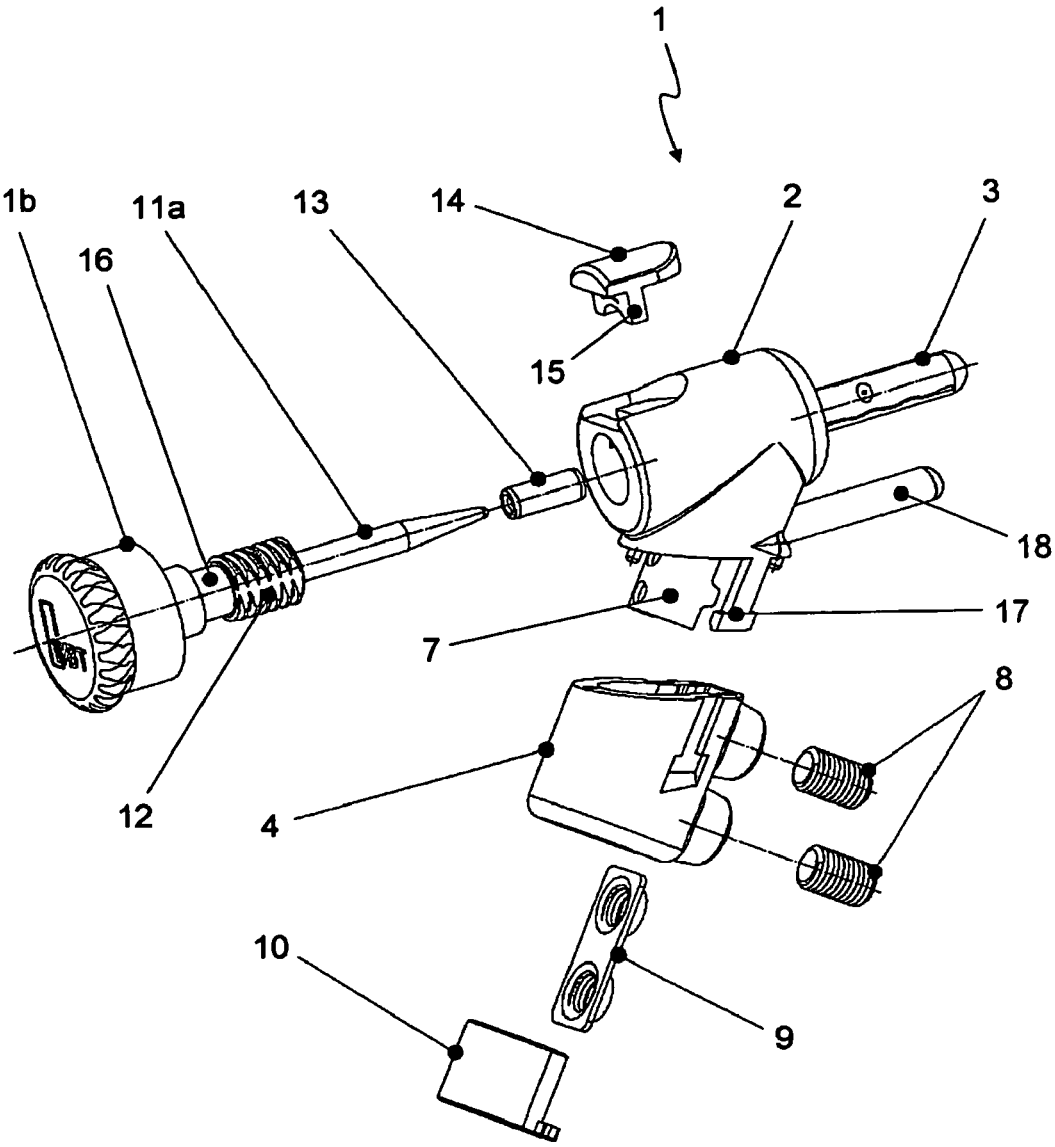
Figure 4:
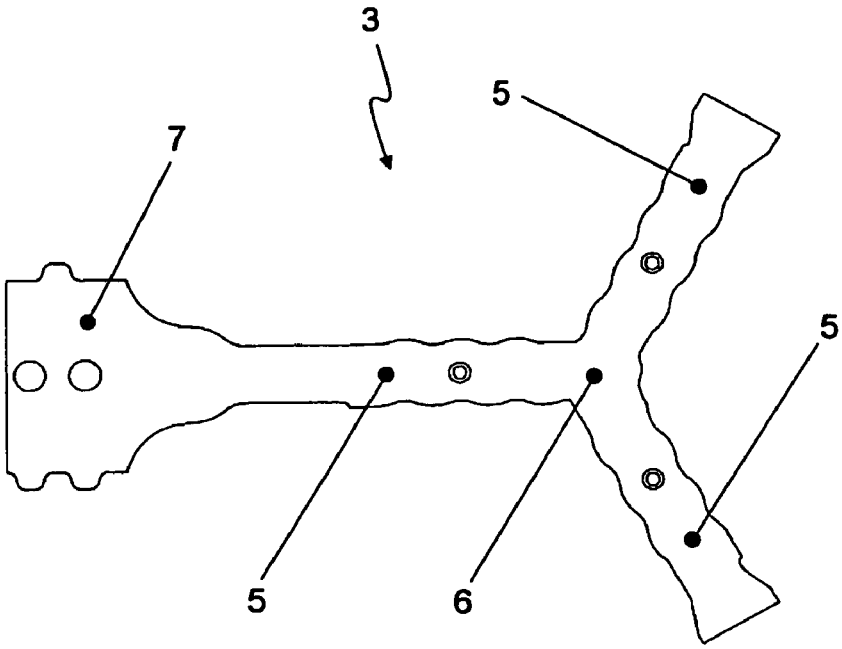
Figure 5:
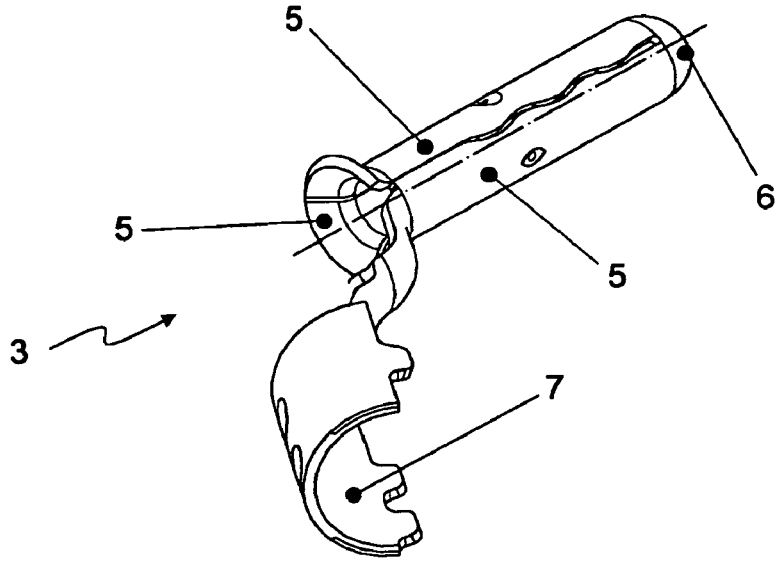
Figure 6:
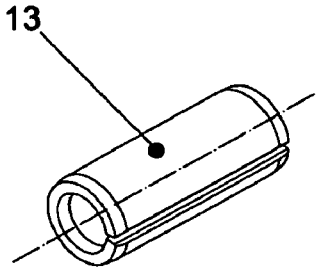
Figure 7:
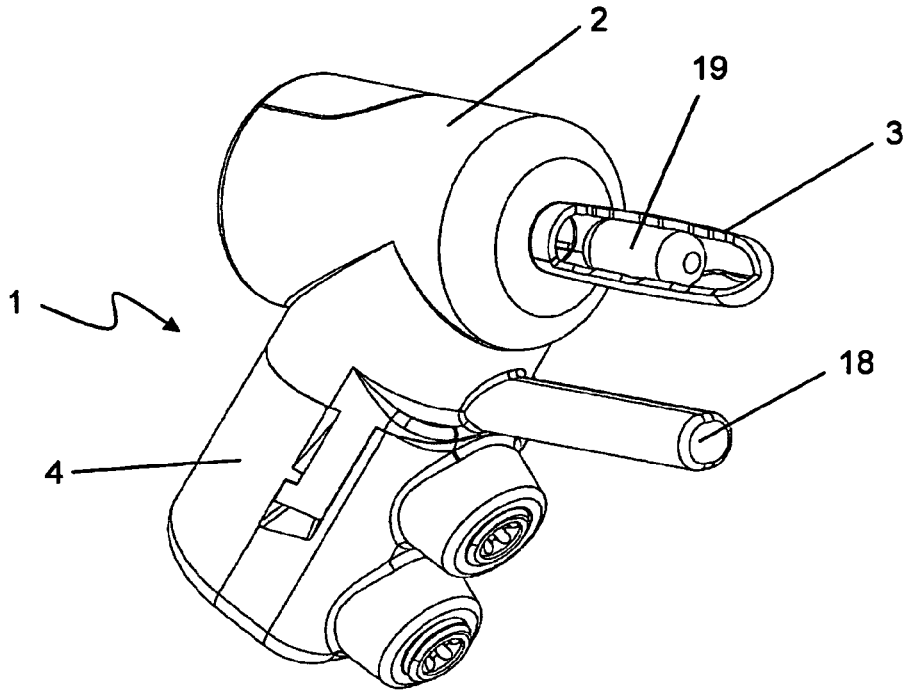
Figure 8:
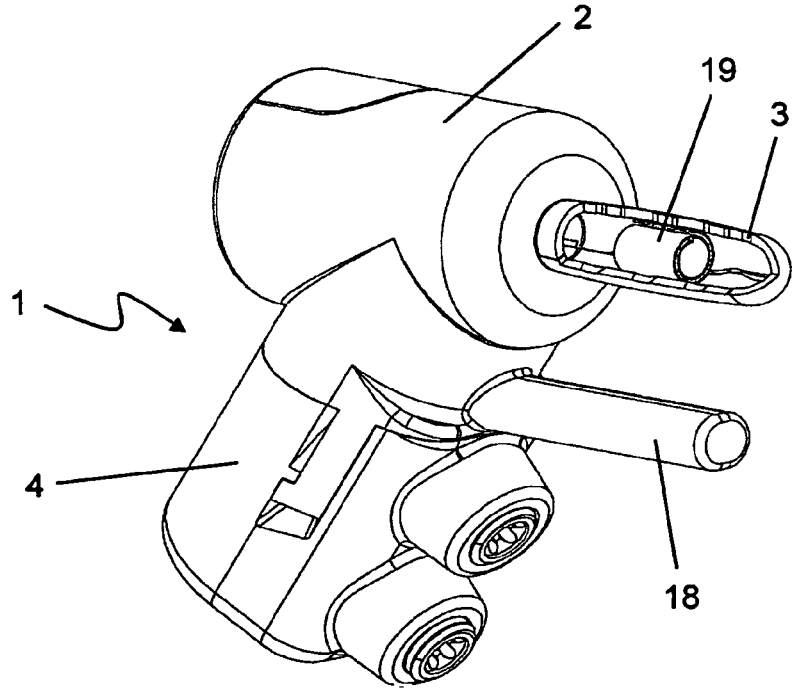

Exemplary embodiments of the invention will be described in greater detail in the following, using the drawings. These show:

FIG. 1 side view of an angled banana plug according to the invention;

FIG. 2 sectional side view of the angled banana plug;

FIG. 3 exploded representation of the angled banana plug;

FIG. 4 developed view of the contact pin of the angled banana plug;

FIG. 5 top view of the contact pin;

FIG. 6 spreader sleeve;

FIG. 7 first exemplary embodiment of the angled banana plug with spreader body;

FIG. 8 second exemplary embodiment of the angled banana plug with spreader body.

In the drawings, the electrical plug connector according to the invention, which is an angled banana plug, is designated as a whole with the reference number 1. The plug comprises a base body 2 as well as a contact pin 3 disposed on the front side of the base body 2. The base body 2 has a connecting cage 4 for accommodating a connecting cable, not shown in any detail in the drawings, and for producing an electrically conductive connection with the contact pin 3. As can be seen in the developed view according to FIG. 4, the contact pin 3 consists of a total of three contact segments 5, which are connected with one another at the front end of the contact pin. The region designated with the reference number 6 in FIG. 4 forms the tip of the contact pin 3 after bending technology deformation. One of the contact segments 5, namely that contact segment 5 that is shown on the left in FIG. 4, is configured to be extended in length as compared with the other contact segments 5, and has a connecting surface 7 for the connecting cable on its end side. After bending technology deformation, the functional shape shown in FIG. 5 is obtained. The extended contact segment 5 is partially embedded in the base body 2, which consists of plastic, as shown in FIG. 2, and extends into the interior of the connecting cage 4. The extended contact segment 5 lies against the inside wall of the connecting cage 4 in the interior of the connecting cage 4. The connecting cable can be pressed against the connecting surface 7 by means of a clamping screw 8, in order to produce the electrical contact with the contact pin 3. In the drawings, two clamping screws 8 are shown. The upper of the two clamping screws serves for production of the electrical contact. The lower clamping screw 8 is provided for fixing the mantling of the connecting cable in place in the connecting cage. Both clamping screws 8 are guided in a metallic threaded plate 9, which is inserted into the base body 2 in the region of the connecting cage 4. At the lower end, the connecting cage 4 has an introduction opening for the connecting cable. The two clamping screws 8 can be screwed in transverse to the introduction direction of the connecting cable. An adaptation sleeve 10 can be inserted into the introduction opening of the connecting cage 4. The inside diameter of the adaptation sleeve 10 essentially corresponds to the outside diameter of the mantle of the connecting cable and thus serves for strain relief. As shown in FIG. 2, the adaptation sleeve has a passage bore for the lower one of the two clamping screws 8. The clamping screw thus fulfills a dual function. It fixes the adaptation sleeve in place in the introduction opening of the connecting cage 4, and at the same time, it fixes the connecting cable in place on the plug 1. A spreader pin 11*a*, 11*b* can be screwed into the base body from its back. The spreader pin is configured to narrow conically at its front end. The front end of the spreader pin 11*a*, 11*b* extends into the contact pin 3, as shown in FIG. 2. The contact pin 3 can be widened radially by screwing in the spreader pin 11*a*, 11*b*. The spreader pin consists of a metallic spindle 11*a* and a handle part 11*b* made of plastic. The spindle 11*a* is embedded in the plastic material of the handle part 11*b*. An outside thread 12 is formed onto the handle part 11*b*, which thread is guided in a corresponding inside thread of the base body 3. A slit spreader sleeve 13 made of spring-elastic material, for example from spring bronze, is disposed in the interior of the contact pin 3, whereby the front end of the spreader pin 11*a*, 11*b*, which narrows conically, moves into the spreader sleeve 13 when it is screwed in, and widens the latter in doing so. FIG. 2 shows the electrical plug connector according to the invention in the unbraced position, in which the spindle 11*a* of the spreader pin is only within the spreader sleeve with the front tip. In FIG. 2, it can be seen that the spreader sleeve 13 has an inside diameter that is clearly smaller than the outside diameter of the spindle 11*a* in the region of its shaft. When the spreader pin 11*a*, 11*b* is screwed in, the spreader sleeve is widened in accordance with the conical shape of the tip of the spindle 11*a*. In this connection, the spreader sleeve transfers a force that is directed radially outward to the contact segments 5 of the contact pin 3. This force acts as a press-down force when the outside surface of the contact pin 3 is pressed against the inside surface of a related jack (not shown in any detail in the drawing). Furthermore, a latch 14 that can be releasably connected with the base body 2 is provided. The latch 14 has a locking projection 15 that engages into a circumferential groove 16 (FIG. 3) applied to the handle part 11*b* of the spreader pin. The latch 14 thus prevents the spreader pin 11*a*, 11*b* from being screwed too far out of the base body 2. As can be seen in the figures, the section of the base body that is angled away relative to the longitudinal axis of the base body 2 and forms the connecting cage 4 can be removed. Engagement crosspieces 17 serve to lock the connecting cage 4 onto the base body. Finally, the figures show a security pin 18 formed onto the base body 2, which prevents the contact pin 3 from being plugged into a power outlet.

In FIGS. 7 and 8, an elastically deformable spreader body 19 that stands under radial bias is disposed in the interior of the contact pin, which body widens the contact pin 3 radially and elastically. In place of the spreader pin 11*a*, 11*b*, the spreader body 19 ensures a good electrical connection in that the outside contact surface of the contact pin 3 is pressed against the inside contact surface of the corresponding jack by means of radial widening of the contact pin 3, and when this happens, the outside diameter of the deformable contact pin 3 is automatically adapted precisely to the inside diameter of the jack. Practically any desired configuration and materials can be selected for the elastic spreader body 19, since the electrical properties of the plug connector are not or only slightly influenced by the properties of the spreader body 19. In order to keep the metal proportion of the plug connector as low as possible, non-metallic materials, such as elastic plastics (rubber) can also be used for the spreader body 19. In the exemplary embodiment in FIG. 7, the spreader body 19 is an elongated plastic body having a cylindrical outside contour and rounded-off face surfaces. In the event of radial compression, the material of the spreader body 19 can escape in the axial direction of the contact pin 3. In the exemplary embodiment shown in FIG. 8, the spreader body 19 is a biased cylindrical spiral spring made of metal. The important thing is to coordinate the elasticity of the spreader body 19 and its bias in such a manner that the friction forces during insertion into the jack do not become too great, whereby at the same time, the quality of the electrical contact is not allowed to suffer.

The invention claimed is:

1. Electrical plug connector, particularly a banana plug, having a base body (2) and a contact pin (3) disposed on the front side of the base body (2), whereby the base body (2) has a connecting cage (4) for accommodating a connecting cable and for producing an electrically conductive connection with the contact pin (3), wherein the contact pin (3) comprises two or more contact segments (5) and is configured as a metallic stamped and bent part, whereby at least one of the contact segments (5) is at least partially embedded in the base body (2), which consists of plastic, and extends into the interior of the connecting cage (4).

2. Electrical plug connector according to claim 1, wherein the contact pin (3) consists of a material having high conductivity, whereby the specific conductivity of the material amounts to at least $50 \cdot 10^6$ S/m, preferably at least $55 \cdot 10^6$ S/m, most preferably at least $60 \cdot 10^6$ S/m.

3. Electrical plug connector according to claim 1, wherein the material of the contact pin (3) is copper or silver.

4. Electrical plug connector according to claim 1, wherein the contact pin (3) consists of at least two contact segments (5) that are connected with one another at the front end (6) of the contact pin (3), whereby one of the contact segments (5) is extended in length as compared with the other contact segments (5), and has a connecting surface (7) for the connecting cable on its end side.

5. Electrical plug connector according to claim 4, wherein the extended contact segment (5) lies against the inside wall in the interior of the connecting cage (4), whereby the connecting cable can be pressed against the connecting surface (7) by means of at least one clamping screw (8).

6. Electrical plug connector according to claim 5, wherein the at least one clamping screw (8) is guided in a metallic threaded plate (9), which is embedded into the base body (2) in the region of the connecting cage (4).

7. Electrical plug connector according to claim 5, wherein the connecting cage (4) has an introduction opening for the connecting cable, whereby the at least one clamping screw (8) can be screwed in transverse to the introduction direction of the connecting cable.

8. Electrical plug connector according to claim 1, further comprising a spreader pin (11*a*, 11*b*) that can be screwed into the base body (2), from its back, whereby the spreader pin (11*a*, 11*b*) extends into the contact pin (3) with its front end, which narrows conically toward the front, so that the contact pin can be radially widened by screwing the spreader pin (11*a*, 11*b*) in.

9. Electrical plug connector according to claim 8, wherein the spreader pin comprises a metallic spindle (11*a*) and a handle part (11*b*) made of plastic, whereby the spindle (11*a*) is embedded in the plastic material of the handle part (11*b*) and whereby the handle part (11*b*) has an outside thread (12) that is guided in an inside thread of the base body (2).

10. Electrical plug connector according to claim 8, further comprising a slit spreader sleeve (13) made of spring-elastic material, disposed in the interior of the contact pin (3), whereby the front end of the spreader pin (11*a*, 11*b*), which narrows conically, moves into the spreader sleeve (13) when the pin is screwed in, and widens the sleeve when this is done.

11. Electrical plug connector according to claim 8, further comprising a latch (14) that can be releasably connected with the base body (2), whereby the latch (14) has a locking projection (15) that engages into a circumferential groove (16) of the spreader pin (11*a*, 11*b*) and thus prevents the spreader pin (11*a*, 11*b*) from being completely screwed out of the base body (2).

12. Electrical plug connector according to claim 1, further comprising an elastically deformable spreader body (19) that stands under radial bias in the interior of the contact pin (3), which body widens the contact pin (3) radially and elastically.

13. Electrical plug connector according to claim 1, further comprising an adaptation sleeve (10) that can be inserted into the introduction opening of the connecting cage (4), whereby the inside diameter of the adaptation sleeve (10) essentially corresponds to the outside diameter of the connecting cable.

14. Electrical plug connector according to claim 13, wherein the adaptation sleeve (10) has a passage bore for at least one clamping screw (8).

15. Electrical plug connector according to claim 1, wherein the base body (2) has a section angled transverse to its longitudinal axis, which forms the connecting cage (4).

16. Electrical plug connector according to claim 15, wherein the base body (2) is configured in multiple parts, specifically in such a manner that the section that forms the connecting cage (4) can be removed.

17. Electrical plug connector according to claim 1, wherein a security pin (18) that runs parallel to the contact pin (3) is formed onto the base body (2), which pin prevents the contact pin (3) from being inserted into a power outlet.

* * * * *